United States Patent [19]

Lane

[11] 4,261,073

[45] Apr. 14, 1981

[54] CHIMNEY SWEEP

[76] Inventor: Byron D. Lane, 212-16th Ave., SW., Minot, N. Dak. 58701

[21] Appl. No.: 63,336

[22] Filed: Aug. 2, 1979

[51] Int. Cl.[3] ..... F23J 3/00

[52] U.S. Cl. ..... 15/163; 15/243

[58] Field of Search ..... 15/162, 163, 210 R, 15/211, 242, 243, 104.16, 104.3 R; D11/141; 46/30

[56] References Cited

U.S. PATENT DOCUMENTS

| | | | |
|---|---|---|---|
| 415,819 | 11/1889 | Purdy | 15/163 X |
| 927,499 | 7/1909 | Davis | 46/30 X |
| 1,530,557 | 3/1925 | Grube et al. | 15/163 |
| 2,446,120 | 7/1948 | Wiswesser | 46/30 X |

FOREIGN PATENT DOCUMENTS

| | | | |
|---|---|---|---|
| 493748 | 2/1950 | Belgium | 15/163 |
| 893430 | 1/1944 | France | 15/242 |

*Primary Examiner*—Edward L. Roberts
*Attorney, Agent, or Firm*—Harvey B. Jacobson

[57] ABSTRACT

A sweep member is provided defining a pair of generally circular disk-shaped assemblies secured together as a single unit with the assemblies each disposed, generally, in a diametric plane of the other assembly generally normal to the medial plane thereof and with the centers of the assemblies generally coinciding. An elongated flexible tension member is attached at one end to a peripheral portion of one of the disk-shaped assemblies remote from the other assembly and the flexible tension member may be supported at the other end thereof with the remaining portion of the tension member depending downwardly therefrom and suspending the sweep member therebelow. The sweep member may be lowered, by means of the tension member, into the upper end of a chimney passage in which the sweep member is loosely, but snugly, received and moved downwardly through the passage while vertically reciprocating the flexible tension member in order that the sweep member may scrap and rub the side walls of the chimney passage clean of foreign material therein. A plurality of the sweep members may be pivotally joined together in chain fashion and a weight member may be suspended from the lowest sweep member in order to facilitate the cleaning operation.

11 Claims, 6 Drawing Figures

CHIMNEY SWEEP

BACKGROUND OF THE INVENTION

Various forms of structures for sweeping the interiors of chimney passages clean have been heretofore provided and most are designed to be lowered down into the chimney passage from the upper end thereof. However, some forms of chimney sweeps are not constructed in a manner whereby they may readily navigate a tortuous chimney passage and other chimney sweeps do not include accessory structures whereby the task of freeing a stuck chimney sweep may be facilitated. In addition, most chimney sweeps do not include structure for vertically reciprocating and yet gradually lowering the chimney sweep downwardly through a chimney passage to be cleaned. Accordingly, a need exists for an improved chimney sweep which will be capable of performing these various functions in addition to operating in a superior manner to achieve the primary function of cleaning a chimney passage.

BRIEF DESCRIPTION OF THE INVENTION

The chimney sweep of the instant invention includes a sweep member for vertical reciprocation in and movement downwardly through a chimney passage and is constructed in a manner whereby the sweep member may perform the desired function of cleaning the associated chimney passage in a superior manner. In addition, the chimney sweep is constructed whereby the likelihood of its becoming stuck in a chimney passage is greatly reduced and the sweep further includes an accessory structure for use in assisting freeing the chimney sweep in the event it becomes stuck within a chimney passage. Still further, the sweep is constructed in a manner whereby it may navigate a tortuous chimney passage.

The main object of this invention is to provide a chimney sweep which may be utilized, by even inexperienced persons, in performing a thorough chimney passage cleaning operation.

Another object of this invention is to provide a chimney sweep in accordance with the preceding object and which includes structure for systematically vertically reciprocating the sweep as the latter is lowered downwardly through a chimney passage to be cleaned.

Another important object of this invention is to provide a chimney sweep constructed in a manner whereby it may readily navigate a tortuous chimney passage.

A still further object of this invention is to provide a chimney sweep including an accessory therefor to facilitate the freeing of the chimney sweep in the event it does become stuck in a chimney passage.

A final object of this invention to be specifically enumerated herein is to provide a chimney sweep in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
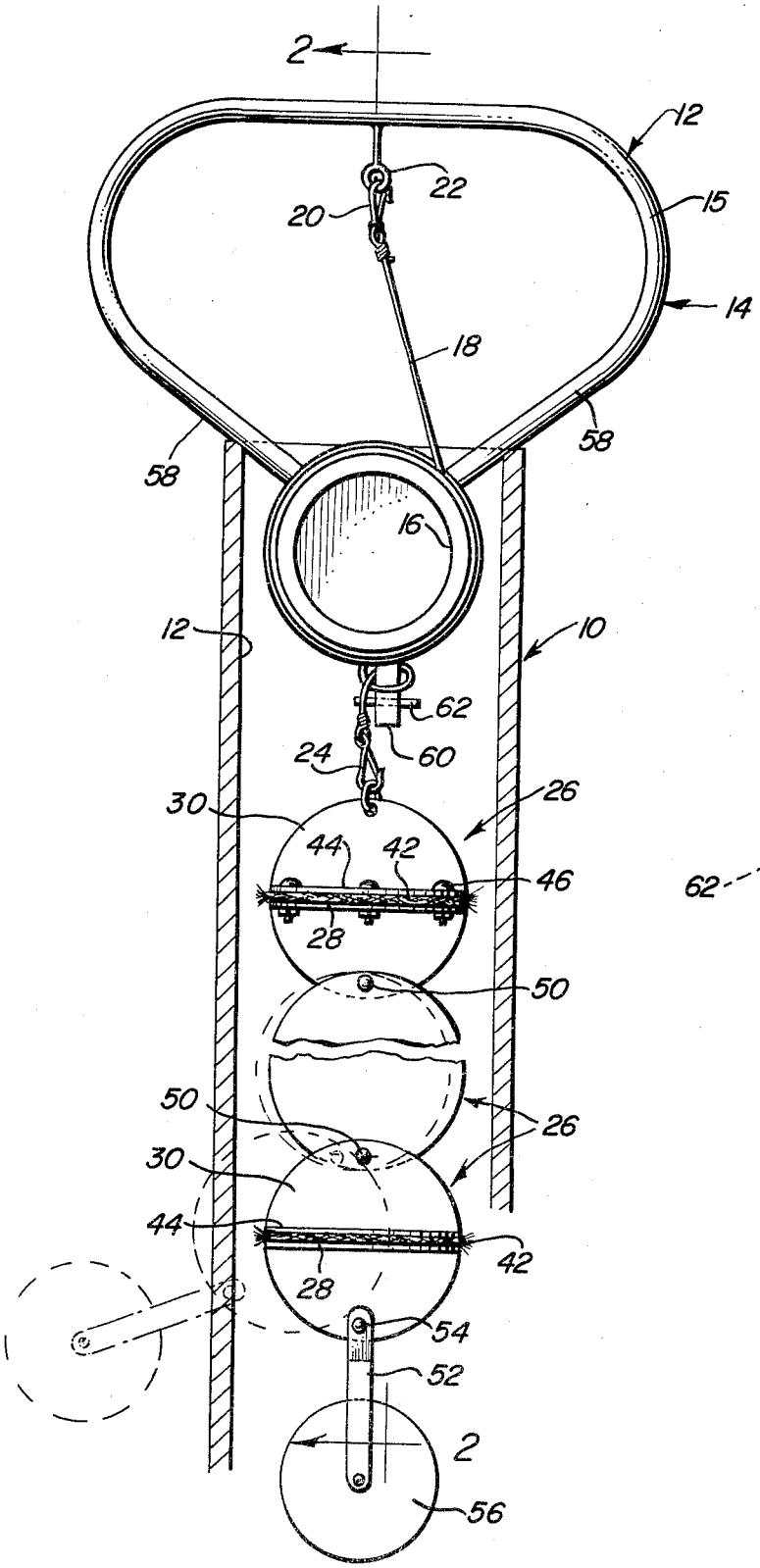
FIG. 1 is a fragmentary, side, elevational view of a first form of chimney sweep constructed in accordance with the present invention and with the sweep operatively associated with a chimney flue pipe.
Figure 2:
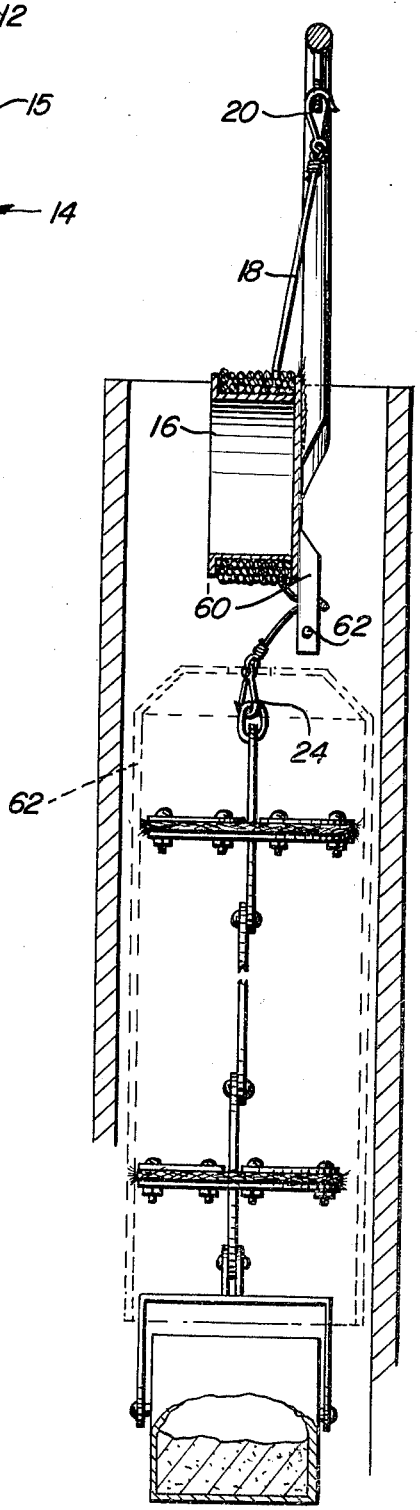
FIG. 2 is a fragmentary, vertical, sectional view taken substantially upon the plane indicated by the section line 2—2 of FIG. 1.
Figure 3:
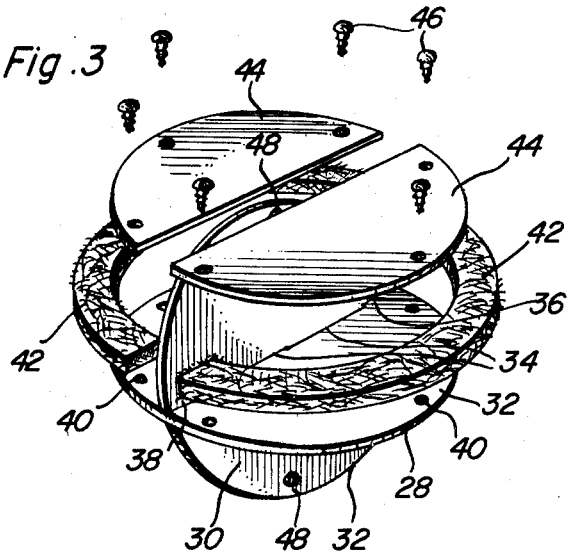
FIG. 3 is an exploded, perspective view of one of the sweep members of the chimney sweep illustrated in FIGS. 1 and 2.
Figure 4:
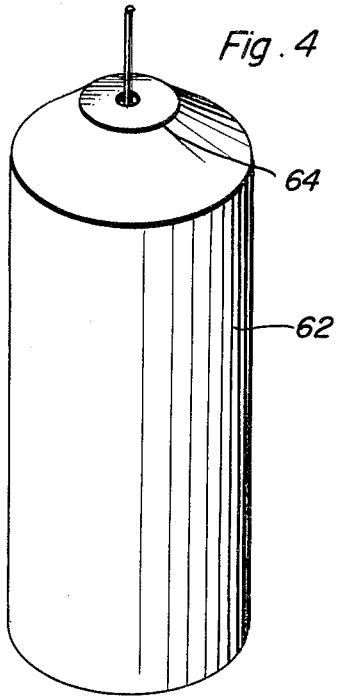
FIG. 4 is a perspective view of an accessory for the chimney sweep to be utilized in assisting in freeing the sweep in the event it becomes stuck in a chimney passage.

Referring now more specifically to the drawings, the numeral 10 generally designates a chimney flue pipe defining an upstanding chimney flue passage 12 extending therethrough. A first form of chimney sweep constructed in accordance with the present invention is referred to in general by the reference numeral 14 and is operatively associated with the pipe 10.

The sweep 14 includes a support frame referred to in general by the reference numeral 15 from which a fixed winding drum 16 is supported and one end of an endless flexible tension member 18 is provided with a snap hook 20 and is anchored through an anchor eye 22 supported from the frame 15. The free end portion of the tension member 18 is wound about the winding drum 16 and extends downwardly therefrom and has a snap hook 24 supported therefrom. The chimney sweep 14 includes a plurality of sweep members each referred to in general by the reference numeral 26. Each member 26 comprises a pair of generally circular disk-shaped assemblies 28 and 30 secured together as a single unit with the assemblies each disposed, generally, in a diametric plane of the other assembly generally normal to the medial plane thereof and with the centers of the assemblies 28 and 30 generally coinciding.

The assemblies 28 and 30 each comprise a circular disk body 32 having a radial slot 34 formed therein. The bodies 32 of the assemblies 28 and 30 are interfitted together with the slotted portion of each embracingly receiving therein the unslotted portion of the other. In this manner, the disk bodies 32 are interfitted together with the medial planes of the bodies disposed at substantially right angles to each other. The bodies 32 are secured together in any convenient manner, as by welding, as at 36 and 38, and the body 32 includes peripherally spaced apertures 40 formed therethrough. Arcuate strips 42 of any suitable form of scubbing pad are lapped over the outer periphery of one side of the body 32 of the assembly 28 on opposite sides of the assembly 30 and a pair of semicircular plates 44 are secured over corresponding semi-circular portions of the body 32 of the assembly 28 with the strips 42 to sandwich between the body 32 of the assembly 28 and the plates 44, fasteners 46 being utilized to secure the plates 44 to the body 32 of the assembly 28. In addition, diametrically opposite portions of the body 32 of the assembly 30 are provided with apertures 48 remote from the assembly 28. Although the chimney sweep 14 may include only a single sweep member 26, it is preferable that a plurality of sweep members 26 be pivotally joined together for relative oscillation by means of fasteners 50 secured through registered bores or apertures 48 in overlapped portions of adjacent sweep members 26. In this manner, a plurality of the sweep members 26 may be pivotally joined together in train fashion. Further, a yoke 52 is pivotally supported from the lowermost portion of the lowermost assembly 30 by means a fastener 54 secured through the corresponding aperture 48 and a weighted roller 56 is journaled from the yoke 52.

The support frame 15 defines a handle including oppositely inclined convergent opposite side portions 58 and the frame 15 further includes a depending shank portion 60 having a cross pin 62 secured therethrough. The free end of the tension member 18 extending from the winding drum 16 is wrapped once about the shank member 60 above the cross pin 62 whereby further unwinding of the tension member 18 from the winding drum 16 may be controlled.

In operation, the frame 15 is supported from the upper end of the pipe 10 in the manner illustrated in FIG. 1 of the drawings with the sweep memers 26 received downwardly within the passage 12 and the weighted roller 56 disposed lowermost. Thereafter the frame 15 may be vertically reciprocated in order that the sweep members 26 may engage and scrap the inner surfaces of the pipe 10 defining the passage 12. Should the passage 12 include bends or curves, the roller 56 will roll smoothly around such bends or curves and guide the pivotally connected sweep members 26 around the curves or bends.

If for any reason the sweep members 26 become stuck, a heavy downwardly opening sleeve member 62 including a centrally apertured upper end wall 64 is threaded onto the upper end of the tension member 18 and allowed to slide downwardly along the latter for telescoping engagement over the sweep members 16. In this manner, the sweep members 16 will be freed from stuck positions within the passage 12. Of course, the downward movement of the sleeve member 62 is limited when the inner surface of the closed upper end or wall 64 of the sleeve member 62 abuts the uppermost sweep member 26.

During vertical reciprocation of the sweep members 26 within the passage 12, the strips 42 serve to scrub and loosen foreign material clinging to the inner surfaces of the passage 12.

Figure 5:
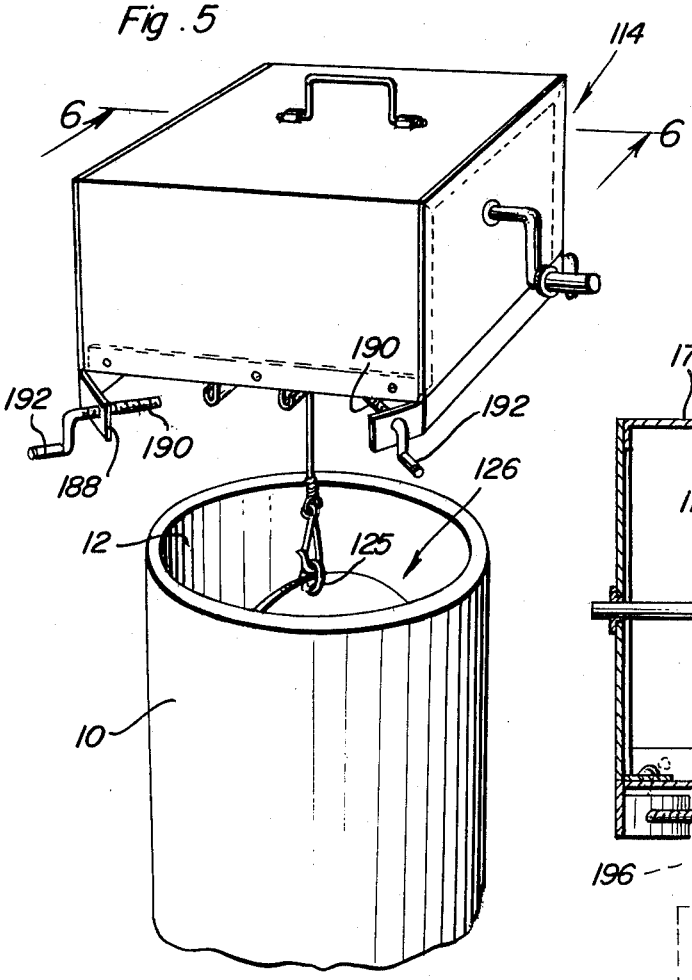
FIG. 5 is a perspective view of a second form of chimney sweep constructed in accordance with the present invention.
Figure 6:
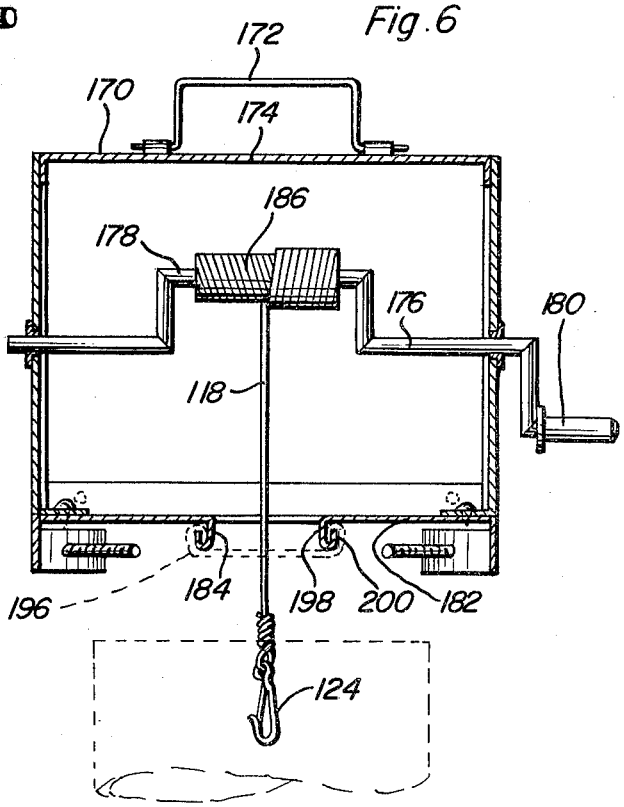
FIG. 6 is an enlarged, fragmentary, vertical, sectional view taken substantially upon the plane indicated by the section line 6—6 of FIG. 5.

With attention now invited more specifically to FIGS. 5 and 6 of the drawings, there may be seen a second form of chimney sweep referred to in general by the reference numeral 114. The chimney sweep 114 is similar to the chimney sweep 14 in that it includes a plurality of relatively pivotally connected sweep members 126 corresponding to the sweep members 26 and may also utilize a yoke and roller on the lower end thereof, such as the yoke 52 and roller 56.

However, the chimney sweep 114 includes a downwardly opening housing 170 having a bale-type handle 172 pivotally supported from its upper wall 174 and a crank 176 including an eccentric throw 178 is journaled through the housing 170 and includes an eccentric crank handle 180 on one end thereof disposed exteriorly of the housing 170. The housing 170 includes a partial bottom wall 182 having a narrow central transverse slot 184 formed therein extending transversely of crank 176 and a tension member 118 corresponding to the tension member 18 extends downwardly through the slot 184 and includes a snap hook 124 on the lower end thereof which is removably engaged with an attaching ring 125 carried by the uppermost sweep member 126.

The upper end of the tension member 118 is wound about a sleeve 186 carried by the throw 178 and the circumference of the sleeve 186 is less than twice the eccentric displacement of the throw 178 from axis of rotation of the crank 176. The housing 170 is positionable over the upper end of the pipe 10 with the bottom wall 182 resting on the upper end of the pipe 10 and the housing 170 includes mounting flange portions 188 adjacent the four corners thereof through which set screws 190 are threadedly engaged, the set screws 190 being provided with eccentric crank handles 192 whereby the set screws 190 may be readily turned.

With the housing 170 positioned over the upper end of the flue pipe 10 and the plurality of sweep members 126 suspended within the passage 12 by means of the tension member 118, the crank 176 may be rotated in a clockwise direction as viewed from the left side of FIG. 5 in order to gradually lower the sweep members 126 downwardly through the passage 12 while at the same time causing the sweep members 126 to be vertically reciprocated in the passage 12. The slot or opening 184 is of a reduced width in order to facilitate maintaining the tension member 118 generally centered within the passage 12 and a removable cover 196 is provided and may be removably secured over the slot or opening 184, the cover 196 being slidably supported from successively downturned and upturned portions 198 and 200 of the bottom wall 182 on opposite sides of the slot or opening 184.

Of course, the sleeve member 62 may be utilized in conjunction with the sweep members 126 of the chimney sweep 114 and the strips 42 of the sweep members 26 as well as the corresponding strips of the sweep members 126 may be readily replaced whenever desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An apparatus for cleaning a chimney passage, said apparatus comprising a sweep member including means defining a pair of generally circular disk-shaped assemblies secured together as a single unit with said assemblies each disposed, generally, in a diametric plane of the other assembly generally normal to the medial plane thereof and with the centers of said assemblies generally coinciding, and an elongated flexible tension member attached at one end to an upper peripheral portion of one of said assemblies remote from the other assembly, said flexible tension member being adapted to be supported at the other end with said one end of said flexible tension member extending down into said passage and the sweep member loosely, but snugly, received in said passage for reciprocation therein upon reciprocation of said flexible member, a weight member of smaller plan area than said sweep member suspended from a lower peripheral portion of said one assembly remote from said upper peripheral portion.

2. An apparatus for cleaning a chimney passage, said apparatus comprising a sweep member including means defining a pair of generally circular disk-shaped assemblies secured together as a single unit with said assemblies each disposed, generally, in a diametric plane of the other assembly generally normal to the medial plane thereof and with the centers of said assemblies generally coinciding, and an elongated flexible tension member attached at one end to an upper peripheral portion of one of said assemblies remote from the other assembly, said flexible tension member being adapted to be supported at the other end with said one end of said flexible tension member extending down into said passage and the sweep member loosely, but snugly, received in said passage for reciprocation therein upon reciprocation of said flexible member, a downwardly opening sleeve body of an inside diameter greater than the maximum plan dimension of said sweep member, guide and abutment means carried by the upper end of said sleeve body slidingly engageable over said tension member for guiding movement therealong and abuttingly engageable with an upper portion of said sweep member upon downward sliding movement of said sleeve body downwardly along said tension member.

3. The combination of claim 1 including a support and stop member of a size adapted to span and be supported from the upper end of said passage, said support and stop members including elongated flexible tension member storage means from which the upper end of said flexible tension member is supported.

4. The combination of claim 3 wherein said storage means comprises a crank member journaled from said support and stop member and including an eccentric throw for winding of said tension member thereon, the effective circumference of said eccentric throw being less than twice the eccentric displacement of said eccentric throw from the axis of rotation of said crank member.

5. The combination of claim 1 wherein said apparatus includes at least one pair of vertically spaced sweep members having lower and upper marginal edges of corresponding disk-shaped assemblies pivotally joined together for oscillation relative to each other about axes disposed generally normal to corresponding disk-shaped assemblies of adjacent sweep members.

6. The combination of claim 5 wherein said weight member is suspended from the lowest sweep member.

7. The combination of claim 5 including a downwardly opening sleeve body of an inside diameter greater than the maximum plan dimension of said sweep member, guide and abutment means carried by the upper end of said sleeve body slidingly engageable over said tension member for guiding movement therealong and abuttingly engageable with an upper portion of the uppermost sweep member upon downward sliding movement of said sleeve body downwardly along said tension member.

8. The combination of claim 1 including a support and stop member of a size adapted to span and be supported from the upper end of said passage, said support and stop members including elongated flexible tension member storage means from which the upper end of said flexible tension member is supported, said support and stop member comprising a downwardly tapering bail type handle seatingly receivable within the upper end of a chimney passage.

9. The combination of claim 8 wherein said handle includes a depending shank portion for projection down into said passage and a cylindrical winding drum supported from said shank portion about which the mid portion of said tension member is wound.

10. An apparatus for cleaning a chimney passage, said apparatus including a sweep member of a plan shape and size to be loosely received downwardly into a chimney passage, an elongated flexible tension member to one end portion of which said sweep member is anchored, an abutment structure adapted to be supported from the upper end of said chimney passage, and storage means movably supported from said abutment and to which the other end portion of said tension member is attached, said storage means including tension member support means to which said other end portion is attached operative, upon movement of said storage means relative to said abutment structure, to selectively gradually lower and raise said tension member in said passage while reciprocating said one end portion along said passage.

11. The combination of claim 10 wherein said storage means includes a horizontal crank shaft journaled from said abutment structure for rotation about a horizontal axis and including an eccentric throw comprising said tension member support means to which said other end portion of said tension member is attached and upon which said other end portion of said tension member is wound for unwinding therefrom.

* * * * *